United States Patent [19]

Schneider

[11] Patent Number: 4,941,350

[45] Date of Patent: Jul. 17, 1990

[54] METHOD AND APPARATUS FOR FORMATION TESTING

[76] Inventor: George F. Schneider, 237 Willow Valley Dr., Lancaster, Pa. 17602

[21] Appl. No.: 335,548

[22] Filed: Apr. 10, 1989

[51] Int. Cl.[5] ..... F21B 49/08

[52] U.S. Cl. ..... 73/155; 166/254

[58] Field of Search ..... 73/151, 155, 863.43, 73/864.73; 166/70, 100, 118, 241, 250, 254, 264; 175/45, 50

[56] References Cited

U.S. PATENT DOCUMENTS

| | | | |
|---|---|---|---|
| 3,173,485 | 3/1965 | Bretzke, Jr. | 166/100 |
| 3,261,402 | 7/1966 | Whitten | 166/100 |
| 4,470,456 | 9/1984 | Moutray, III | 166/100 |

FOREIGN PATENT DOCUMENTS

| | | | |
|---|---|---|---|
| 776481 | 1/1968 | Canada | 166/100 |

OTHER PUBLICATIONS

Schlumberger workbook entitled "Open Hole Repeat Formation Tester 'RFT'", compiled by: E. Havard, (Spring, 1982), cover and pp. 1-1 to 1-5.

Western Atlas International, Atlas Wireline Services Workbook entitled "Formation Multi-Tester (FMT) Principles, Theory, and Interpretation", 1987 (author unknown), cover and title page and pp. 1-7.

Schlumberger specification sheet entitled "Cased Hole Repeat Formation Tester", 2 pgs. (author and date unknown).

*Primary Examiner*—Hezron E. Williams

*Assistant Examiner*—Kevin D. O'Shea

*Attorney, Agent, or Firm*—Howson and Howson

[57] ABSTRACT

Apparatus and method are disclosed for testing and sampling fluid in an oblong borehole of fracture zones in the area maximum permeability for more efficient recovery and testing in a given sampling period. The tester includes a pair of oppositely extending arms urged against the sides of the borehole causing the tester to rotate until a sampling probe oriented 90° from the arms aligns with the short axis of the borehole. A probe is also disclosed having an elongate slot oriented perpendicular to the borehole for covering a greater horizontal sampling area.

18 Claims, 4 Drawing Sheets

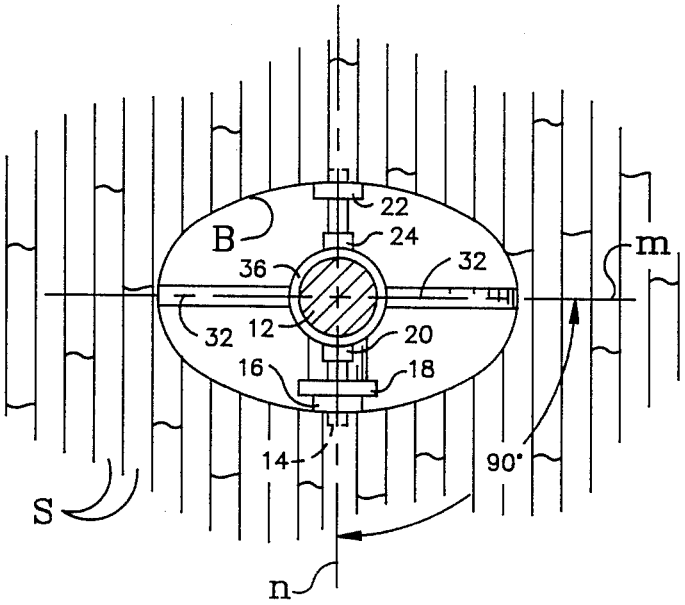
FIG. 7
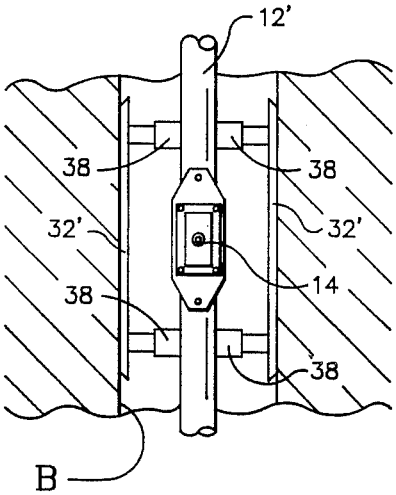
FIG. 8
FIG. 9
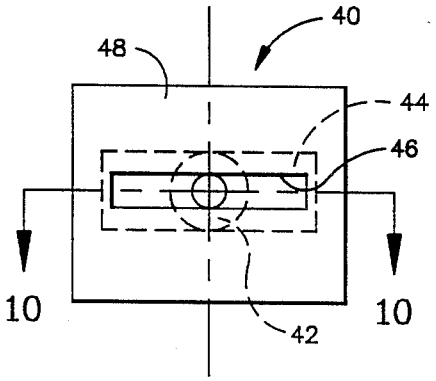
FIG. 10
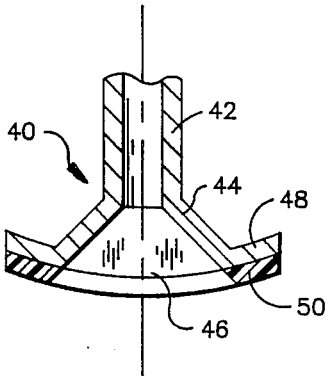

METHOD AND APPARATUS FOR FORMATION TESTING

BACKGROUND OF THE INVENTION

The present invention relates to geological well logging, and more particularly to methods and apparatus for testing geologic formations.

Various wireline instruments and techniques are employed in logging of uncased boreholes to measure the properties of drilled section and the fluids contained in the rock interstices for evaluating the productive capabilities of petroleum reservoir formations. After running electrical, sonic, nuclear, and other wireline logs to identify zones of interest in a borehole, a wireline formation tester may be lowered for measuring subsurface formation and hydrostatic pressures and for taking diagnostic fluid samples. At selected depths, a back-up shoe is set against one side of the borehole to press a probe or "snorkel tube" into, or tightly against, the formation on the opposite side. This provides a good seal for allowing a fluid sample from the formation to collect in a sampling chamber free of any drilling fluid.

The ability to collect a sample and the rate at which the fluid sample is recovered depend upon, among other factors, the formation's permeability, or degree to which the interstices or pores are interconnected, at the snorkel tube. In homogeneous clean sandstones and unfractured limestones, the permeability is substantially uniform in all directions, consequently, the orientation of the snorkel tube in the borehole will not affect the flow rate. In fractured formations, on the other hand, the permeability varies significantly around the borehole. Therefore, the orientation of the probe against the formation will affect the amount of recovery and the sample recovery rate.

Prior art testers make no provision for positioning the snorkel tube in the area of greatest permeability. In fact, some formation testers by their very design consistently place the snorkel tube in areas of the formation where there is least permeability. Consequently, little or no sample is obtained or the time consumed in obtaining a satisfactory quantity of a diagnostic fluid sample is unnecessarily long, and costly in terms of manhours. Even if the snorkel tube were, by chance, positioned in the area of highest permeability, its orifice communicates with a very small area of the formation, thus further limiting the sample recovery rate.

SUMMARY OF THE INVENTION

Accordingly, it is an object of the present invention to provide an improved formation tester for better and more rapid recovery of diagnostic fluid samples from subsurface formations.

Another object of the invention is to provide a formation tester for geological logging in which diagnostic fluid samples are recovered from areas of high permeability of a borehole in a fracture zone of interest.

Still another object of the invention is to provide an improved method for sampling liquid and gas samples in subsurface formations at a preferred orientation of a sampling probe.

A further object is to provide an improved probe for sampling a large area of a borehole in a fracture zone of interest.

Yet another object of the invention is to provide apparatus which can be readily adapted to present formation testing devices for orienting a sampling probe in a borehole in the area of highest permeability, and which is reliable and inexpensive to manufacture and maintain.

Briefly, these and other objects and aspects of the invention are accomplished with a wireline formation tester electrically controlled from the surface and lowered to a fracture zone of interest in an uncased or open borehole for measuring and recording fluid pressures and for recovering fluid samples through a probe positioned at the area of maximum permeability. The tester includes a generally elongate housing and a power-operated cylindrical sampling probe which is laterally extended against the borehole wall. Pressure readings are taken as desired, and fluid samples recovered in collecting chambers. A pair of arms symmetrically extendable from opposite sides of the housing in a longitudinal plane 90° displaced from the probe, urge against the opposite walls of the borehole before extending the probe. In a generally elliptical or oblong borehole the extended arms rotate the housing to a position where they contact the sides of the borehole which are farthest apart and generally align with the long axis of the borehole. The sampling direction will, therefore, always be along the short axis of the borehole where there is maximum permeability in the formation. An alternative embodiment of the sampling probe includes an elongate aperture transverse to the length of the housing for exposing a greater sampling area of optimum permeability for improved fluid sample recovery.

BRIEF DESCRIPTION OF THE DRAWINGS

For a better understanding of these and other objects and aspects of the invention, reference may be made to the following detailed description taken in conjunction with the accompanying drawings wherein:

FIG. 7 is a cross-sectional view of the formation tester of FIG. 5 taken along the line 7—7;

FIG. 8 is a schematic representation in elevation of an alternate embodiment of a formation tester according to the invention positioned within a borehole;

FIG. 9 is a frontal view of an alternate embodiment of a sampling probe according to the invention for a formation tester; and FIG. 10 is a cross-sectional view of the probe of FIG. 9 taken along the line 10—10.

DESCRIPTION OF THE PREFERRED EMBODIMENTS

Structural deformation as applied to consolidated sedimentary or metamorphic rocks create fractures which are oriented in definite patterns in relation to bedding planes and to the resultant structure, i.e. dip, strike, and plunge of the flexure or fold. Referring to the geologic structure of FIG. 1, a simple anticlinal fold of sand and shale strata is shown about an axis F—F plunging to the left from a horizontal datum. This produces a definite pattern of fractures in the shale related to the flexure created by the fold. The intersection of the fracture planes and the shale bedding planes is at approximately 90° and forms elongate fissile shale or splinters S, often referred to as pencil structures, longitudinally oriented with the fold axis F—F. As the axis of the fold changes direction, the long axes of splinters S precisely follow. This is illustrated in the domal fold of FIG. 2.

Figure 1:
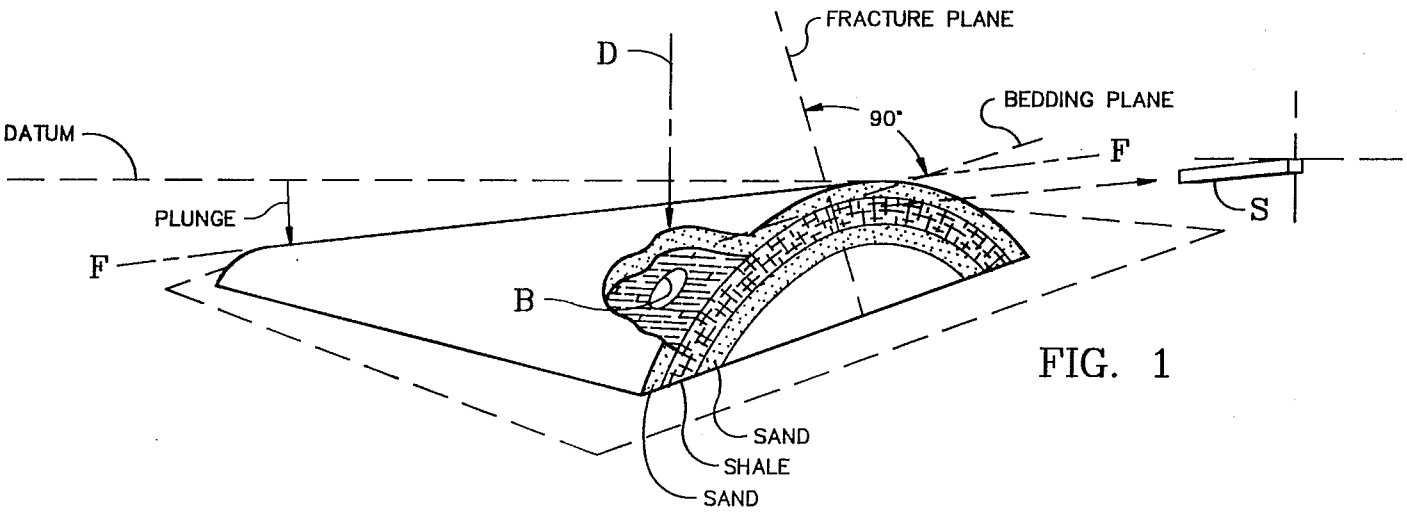
FIG. 1 is a perspective view in cross-section with a borehole on the left flank of a plunging fold of a schematically illustrated geologic structure.

Splinters S are disproportionately enlarged in FIG. 1 to illustrate their generally square cross-sectional configuration, and even if crushed to microscopic dimensions, the square configuration remains reflecting that the weak fracture planes always intersect the bedding planes at 90° and are dominant to the bedding planes. For example, common roofing slate which is metamorphosed shale splits on fracture planes and not on bedding planes. This fracture phenomenon frequently impedes drilling operations because of extreme sloughing of the splinters into the borehole and potential stuck pipe. These adverse conditions notwithstanding, such formations are valid candidates for exploration rather than undisturbed layercake deposits offering no hydrocarbon traps.

Figure 3:
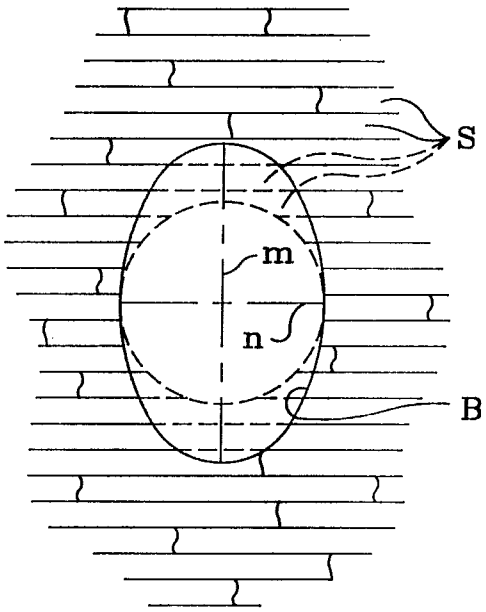
FIG. 3 is a plan view of the structure of FIG. 1 at the borehole.

FIG. 1 shows a fractured, subsurface formation on the flank of the plunging fold disturbed by a drill bit on a vertical axis D as causing sloughing from two opposite sides of a borehole B in the direction perpendicular to the elongate orientation of the splinters. As illustrated in FIG. 3, splinters S shown in dotted outline slough off from the top and bottom sides of borehole B diagram leaving a generally elliptical or oblong configuration with a long axis m perpendicular to the length of splinters S and a width on the short axis n the same as or near the drill bit diameter. By analogy, imagine a stack of pencils, representing the splinters, piled on a desk in the same alignment. If the desk were bumped, the stack would collapse with the pencils moving sidewise perpendicular to their alignment. The splinters in a borehole have similar preferential direction of movement resulting in a generally elliptical borehole whenever a fracture formation is disturbed.

Figure 2:
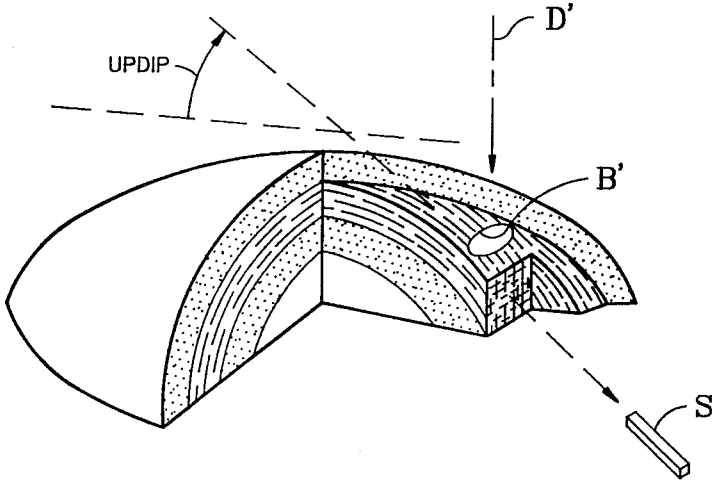
FIG. 2 is a perspective view of a borehole in the upper right quadrant of a schematically illustrated geologic, domal structure.

From earlier observations, it has been shown that the long axis of a borehole on the flank of a plunging fold will always have an alignment which will deviate from updip an amount proportional to the plunge. If there is no plunge, the resultant circular elongation on the flank of the fold will be oriented with its long axis aligned with the vertical plane of the updip angle. From studies of formations overlying salt domes where the uplift or heave resulted in a domal structure such as illustrated in FIG. 2, the fracturing created a radial pattern of splinters S in which the intersections of their fracture planes with the bedding plane produced splinters coincident with the dip at a particular flank. Accordingly, the elliptical or oblong borehole always orients with the short axis pointing updip, no matter where encountered. Where a structural dip determined by a dipmeter was questionable, it can be resolved by observing the orientation of the borehole ellipse. Although the short axis also defines the downdip direction, the updip direction must be selected from two possibilities. Enough seismic data are usually available to determine which is which.

Figure 4:
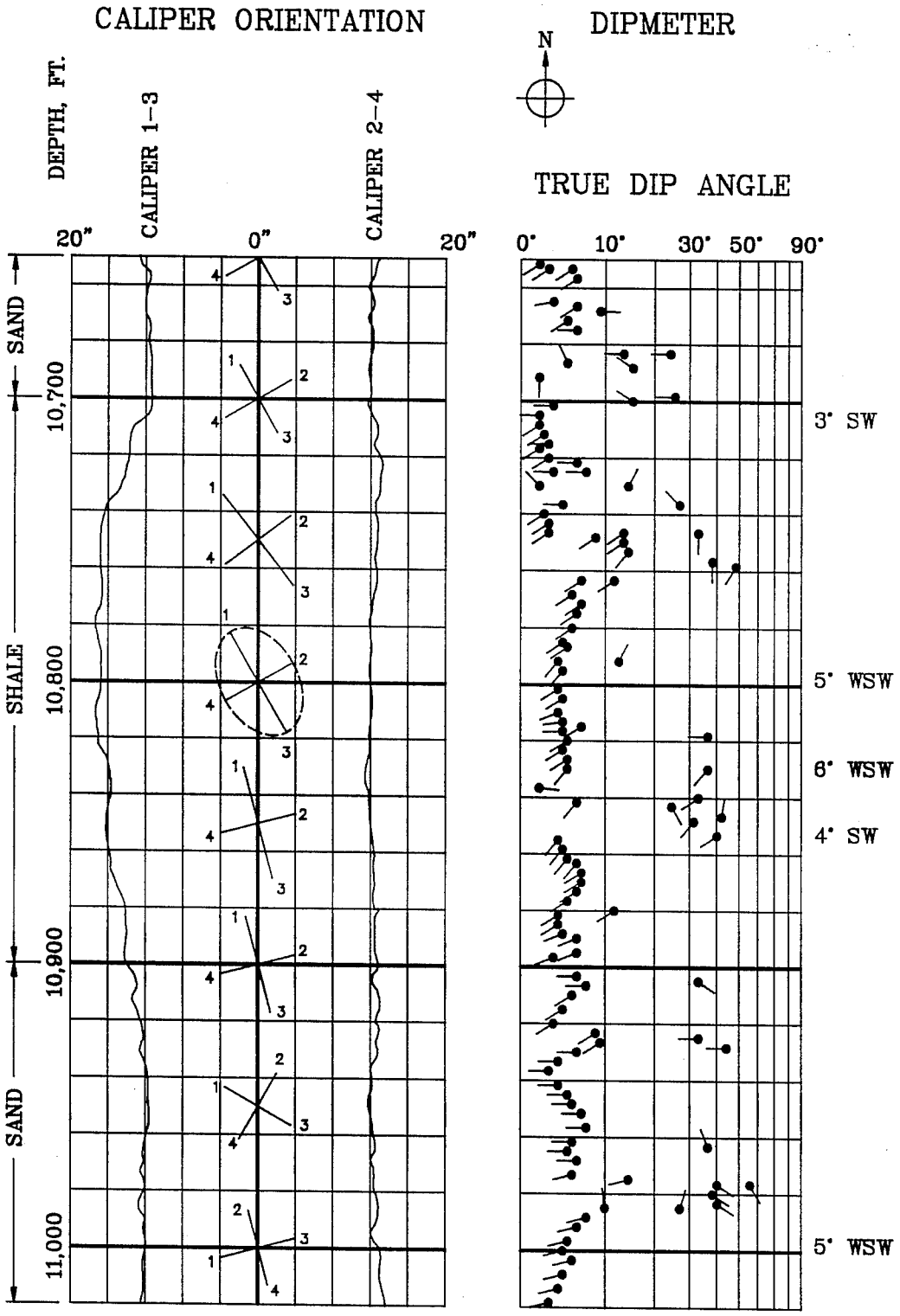
FIG. 4 represents a dipmeter log of a typical sand and shale section of a borehole superimposed with interpretive notations.

An actual dipmeter log in FIG. 4, abridged for clarity, corroborates the above-described relationship of fractures to structure in a shale and sand section. The caliper orientation chart on the left is a record of the distance across the borehole on conventional well logging calipers 1-3 and 2-4 on axes 90° apart; and the dipmeter or "tadpole" chart on the right is a record of the true dip angle and the azimuth of the updip angle of a measured plane determined from resistivity measurements. For ease of interpretation, the caliper measurements in scaled lines have been added to the chart for selected depths in the orientation read from the corresponding azimuth record. It will be noted that the orthogonal caliper measurements in sand between 10,650 and 10,700 ft. and from 10,900 to 11,100 ft. are substantially equal indicating a circular borehole. This is as expected since there would be no sloughing off of fissiled shale splinters. However, in the shale strata between 10,700 to 10,900 ft., there is a discrete increase in length across calipers 1-3 indicating an elliptical borehole; and at 10,800 ft., for example, the azimuth of calipers 2-4 is approximately West-Southwest (and East-Northeast) which is in substantial agreement with the azimuth of the structural dip indicated by the tadpole plot of the dipmeter.

Having thusly shown that the elliptical orientation of the borehole bears a direct relationship to fracture alignment and structure, it follows that the preferred direction for optimum recovery of diagnostic fluid samples is along the short axis of the borehole where the probe is exposed to areas of maximum permeability. Most prior art formation testers, to the contrary, align the sampling probe with the long axis of the borehole. This inherently taps the sides of the splinter structures, rather than the ends where there is the greatest permeability, and consequently fastest and greatest recovery.

The present invention in contradistinction provides for recovering fluid samples from a selected depth in a borehole at the area of maximum permeability. Referring now to the embodiment of FIGS. 5, 6, and 7 wherein like characters designate like or corresponding parts throughout the several views, there is shown a formation tester 10 according to the invention lowered to a fracture formation zone of interest in a borehole by and depending from a cable, not shown, and operatively extended for receiving a fluid sample. Except as otherwise described herein, the fluid pressure measuring and sampling components of the tester may be of conventional design such as disclosed in the publications "Formation Multi-Tester (FMT) Principles, Theory, and Interpretation", 5M 10/87 AT87-071 9575, 1987, by Western Atlas International, Houston, Texas, and "Open Hole Repeat Formation Tester 'RFT'", compiled by E. Havard, Spring, 1982, by Schlumberger, Houston, Tex.

Tester 10 includes a spindle or housing 12 with a laterally slidable sampling probe 14 of circular cross section at the exposed orifice which communicates with pressure transducers and sample collecting chambers, not shown, in housing 12. A resilient pad 16 mounted on a packer plate 18, fixed to the outer end of probe 14, seals the probe and formation interface to prevent sample contamination from drilling fluids and other slurry. Hydraulically operated pistons 20 at the ends of plate 18 radially extend the probe into contact with the formation, and similarly actuated pistons 24 extend a backup shoe 22 in the opposite direction of probe 14. With the probe positioned at the desired depth and orientation, pressure simultaneously applied to pistons 20 and 24 force probe 14 and backup shoe 22 against the opposite sides of borehole B. The pistons are hydraulically operated by electrical signals transmitted by wire along the cable from a control center (not shown) at the well site.

Figure 6:
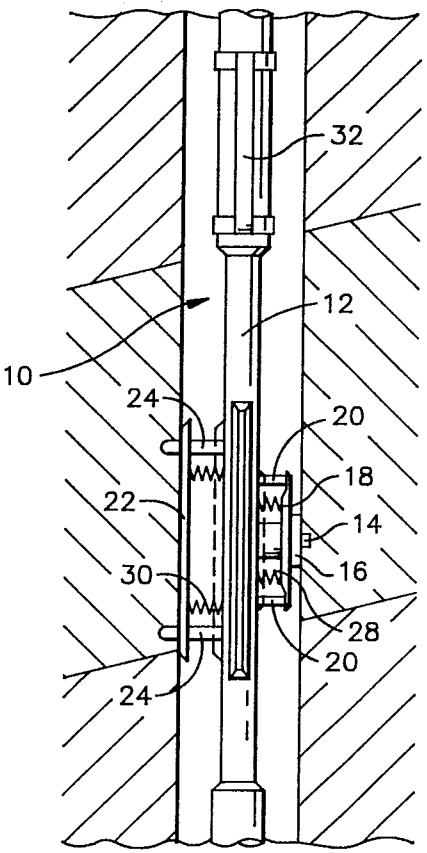
FIG. 6 is an elevation view of the formation tester of FIG. 5 taken along the line 6—6.

With formation tester 10 positioned as shown in FIG. 6, fluid pressures, flow rates and samples of the formation fluid at probe 14 may be taken in response to signals electrically transmitted from the control center. After completing measuring and sampling, the hydraulic pressures applied to pistons 20 and 22 are reversed to retract packer plate 18 and backup shoe 22 from the sides of the formation. Tension springs 28 are provided as supplementary forces to plate 18 and backup shoe 22 to insure positive retraction in the event of a failure of hydraulic pressure while probe 14 is in the borehole. Formation testers with plural sample collecting chambers (not shown) in the housing 12 permit several samples to be taken at the same location or at other depths.

The orientation or azimuth of housing 12 and probe 14, as noted above, is critical at fractured formations. In clean granular formations, such as nonlaminated sand, fluids within the interstices will flow at the same rate in any direction; hence, probe orientation is irrelevant since the permeability around the borehole is substantially uniform. In fractured formations, however, the borehole is generally elliptical or oblong with the permeability highest across the opposite surfaces intersecting the short axis of the borehole. The present invention orients probe 14 at these surfaces for improving the sample recovery amount and rate.

Figure 5:
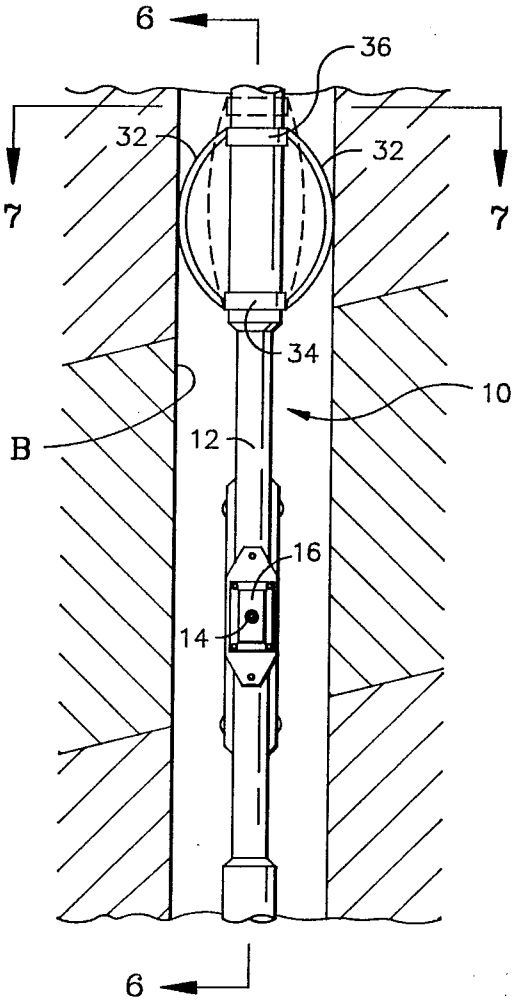
FIG. 5 is a schematic representation in elevation of a formation tester according to the invention entirely positioned within a fractured, elliptical borehole.

In the embodiment of FIGS. 5, 6, and 7, this is accomplished with a pair of oppositely arched springs 32, each connected at one end to a collar 34 fixed to housing 12 and the other end connected to a collar 36 slidable along the length of housing 12, as shown in dotted outline in FIG. 6. Springs 32 are preferably displaced above or below the probe 14 so that advantage can be taken of the maximum ellipticity expressed in shale bounding the interval to be sampled. The dotted outline represents the expansion of springs 32 as tester 10 passes through, for example, a sand zone having a borehole equal to the diameter of the drill bit or smaller than the drill bit because of mud cake on the sides of the borehole. When tester 10 reaches an elliptical shape in the borehole, springs 32 (if not already aligned with the major axis of the ellipse), will impart a torque to the housing 12 in a direction aligning probe 14 with the minor axis. In the event that springs 32 are precisely aligned on the minor axis, a slight displacement may be necessary in order to develop the torque required to initiate rotation and alignment toward the major axis.

Springs 32 are fixed to housing 12 90° displaced from the axis of probe 14. Consequently, when springs 32 align with the surface intersecting the major axis, probe 14 aligns with one of the surfaces intersecting the short axis of the elliptical bore, as shown in FIG. 7. At this position, probe 14 is at the formation area of optimum permeability to afford better pressure measurements and fluid sampling. Better recovery is also achieved in fractured carbonate zones where total effective porosity is extremely small and restricted to fractures.

An alternate embodiment for springs 32 is illustrated in FIG. 8. Probe 14 is oriented along the minor axis of an elliptical borehole by a pair of opposed shoes 32', hydraulically extendable from a housing 12' by pistons 38 and radially displaced 90° from probe 14. At the sampling zone of interest, shoes 32' are first extended against the formation wall causing housing 12' to rotate and align probe 14 and shoe 22 on the short axis. Plate 18 and shoe 22 may then be extended to abut the opposed sides. This arrangement would be especially desirable in highly-fractured carbonate zones.

The circular cross-sectional area at the tip of probe 14 being relatively small, limits the sampling area for the fluid recovery. The present invention provides in the alternate embodiment of FIGS. 9 and 10 a slotted probe 40 in which tube 42 telescopes from housing 12 in the same manner as probe 14 but includes a flared end 44 forming an elongated aperture or slot 46 in an arcuate flange 48. In its simplest form, probe 40 resembles an oblate funnel. The curvature of flange 48 approximates the curvature of the borehole at the probe position and can be fitted at the surface to conform to bit size and anticipated borehole configuration; however, a resilient packer seal 50 may be fixed to the face of flange 48 to accommodate both circular and elliptical bore configurations of a drill hole.

Some of the many advantages of the invention should now be readily apparent. For example, a formation tester is provided which self-orients the sampling probe at the area of optimum permeability for optimum recovery of diagnostic fluid samples from subsurface formations, and which can be readily adapted to existing formation testers. A method is disclosed which assures optimum recovery of fluid samples by orienting the probe along the fracture planes of a formation. A novel probe is also provided which greatly enlarges the surface area sampled at a given position of the formation tester.

It will be understood, of course, that various changes in the details, steps, and arrangement of parts, which have been herein described and illustrated in order to explain the nature of the invention, may be made by those skilled in the art within the principle and scope of the invention as expressed in the appended claims.

I claim:

1. Formation testing apparatus for collecting a fluid sample from an oblong borehole in a fracture zone of interest, the borehole defining orthogonal long and short axes in a plane normal to the length of the borehole and having a relatively slippery film buildup on the sides thereof, comprising, in combination:

an elongate support means;

probe means laterally extendable from said support means for recovering the fluid sample from one side of the borehole; and orienting means laterally extendable from said support means perpendicular to said probe means against opposite sides of the borehole for slidably rotating with said support means until said probe means closely aligns with the short axis of the borehole;

whereby the fluid sample is recovered from an area of relatively high permeability in the zone of interest.

2. Apparatus according to claim 1 wherein:

said orienting means includes arched springs fixed at the one ends to opposite sides of said support means, and slidable at the other ends along the length of said support means, said springs being formed intermediate the ends to compress against opposite sides of the borehole.

3. Apparatus according to claim 1 wherein:

said orienting means includes shoes disposed on opposite sides of said support means, and actuators for extending said shoes against opposite sides of the borehole.

4. Apparatus according to claim 1 wherein:

said orienting means is disposed in spaced relation from said probe means along the length of said support means.

5. Apparatus according to claim 1 wherein:

said orienting means is positioned along the length of said support means coincident with said probe means.

6. Apparatus according to claim 1 wherein:

said probe means includes a flared member with an elongate aperture disposed perpendicular to the length of said support means for increasing the horizontal collecting area of the borehole.

7. Apparatus according to claim 6 wherein:

said probe means further includes an arcuate flange around said aperture substantially congruent with the curvature of the borehole about the short axis thereof.

8. In a formation tester for collecting a fluid sample from an area of relatively high permeability in a zone of interest of a generally elliptical borehole, the borehole defining orthogonal long and short axes in a plane normal to the length of the borehole and having a relatively slippery film buildup on the sides thereof, in which a sampling probe is extendable from a generally cylindrical housing to one side of the borehole, the improvement comprising:

orienting means radially extendable from said housing to another side of the borehole in a plane along the cylindrical axis of the housing and perpendicular to the extendable direction of the probe for slidably rotating the housing until the probe aligns with the short axis of the borehole.

9. Apparatus according to claim 8 wherein:

said orienting means includes arched springs formed to be fixed at the one ends to opposite sides of the housing, and slidable at the other ends along the length of the housing, said springs being formed intermediate the ends to compress against opposite sides of the borehole.

10. Apparatus according to claim 8 wherein:

said orienting means includes shoes formed to be disposed on opposite sides of the housing, and actuators for extending said shoes against opposite sides of the borehole.

11. Apparatus according to claim 8 wherein:

said orienting means is disposed in spaced relation from the probe means along the length of the housing.

12. Apparatus according to claim 8 wherein:

said orienting means is positioned along the length of the housing coincident with the probe means.

13. In a formation tester including a housing for collecting a fluid sample from a borehole, the improvement comprising:

a flared member with an elongate aperture formed to be disposed perpendicular to the length of the borehole for increasing the sample collecting area.

14. The improvement according to claim 13 wherein:

said flared member further includes an arcuate flange around said aperture substantially congruent with the curvature of the borehole.

15. An improved method for collecting a fluid sample from a fractured formation in an area of relatively high permeability of an oblong borehole, the borehole defining orthogonal long and short axes in a plane normal to the length of the borehole, comprising the steps of:

lowering a formation tester in the borehole to a zone of interest in the formation;

determining the orientation of the fracture planes at the zone;

aligning a probe of the tester with the fracture planes; and extending the probe against the formation for receiving fluid present in the zone.

16. A method according to claim 15 wherein:

said determining step includes locating the long axis of the borehole; and said aligning step includes rotating the probe until it is coincident with the short axis of the borehole.

17. A method for engaging a probe against a side of an oblong hole at the intersection with the short axis thereof, the borehole having relatively slippery sides, comprising the serial steps of:

inserting an elongate cylinder in the hole;

radially extending arms from the cylinder against the opposite sides of the hole causing the cylinder to rotate slidably within the hole until the arms closely align with the long axis of the hole; and radially extending the probe from the cylinder in a plane at 90° from the arms against the sides of the hole.

18. Apparatus for investigating a side of a generally elliptical hole at the intersection with the minor axis thereof, the borehole having relatively slippery sides, comprising:

an elongate cylinder formed to freely rotate in the hole on the longitudinal axis thereof;

a pair of members radially extendable from opposite sides of said cylinder;

first force exerting means operatively connected between said members and said cylinder for urging said members to extended positions against opposite sides of the hole and causing said members to rotate slidably with said cylinder about the longitudinal axis toward close alignment with the major axis of the hole;

a probe extendable from said cylinder adjacent to said members in a radial plane 90° from said members; and second force exerting means operatively connected to said cylinder and said probe for selectively extending the probe against the side of the hole when said members are closely aligned with the major axis.

* * * * *